US007423260B2

(12) United States Patent
Overney et al.

(10) Patent No.: US 7,423,260 B2
(45) Date of Patent: Sep. 9, 2008

(54) APPARATUS FOR COMBINED LASER FOCUSING AND SPOT IMAGING FOR MALDI

(75) Inventors: Gregor Overney, San Jose, CA (US); Jean-Luc Truche, Los Altos, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 484 days.

(21) Appl. No.: 11/266,950

(22) Filed: Nov. 4, 2005

(65) Prior Publication Data

US 2007/0102632 A1 May 10, 2007

(51) Int. Cl.
*H01J 49/04* (2006.01)

(52) U.S. Cl. ..... 250/288; 250/281; 250/284

(58) Field of Classification Search ..... None
See application file for complete search history.

(56) References Cited

U.S. PATENT DOCUMENTS 5,905,259 A * 5/1999 Franzen ..... 250/287
6,423,966 B2 * 7/2002 Hillenkamp et al. ..... 250/288
6,680,477 B2 * 1/2004 Beck et al. ..... 250/288
6,707,039 B1 * 3/2004 Truche et al. ..... 250/288
7,091,482 B2 * 8/2006 Truche et al. ..... 250/288
7,135,689 B2 * 11/2006 Truche et al. ..... 250/425
7,180,058 B1 * 2/2007 Izgarian ..... 250/288
7,180,059 B2 * 2/2007 Fischer et al. ..... 250/288

* cited by examiner

*Primary Examiner*—David A. Vanore

(57) ABSTRACT

A MALDI ion source includes a sample plate for receiving a sample, a laser for producing laser radiation to ionize the sample, a first optical element arranged so as to direct the laser radiation along a first optical path toward the target area, and a second optical element arranged along the first optical path to focus the laser radiation onto the target area. The first and second optical elements are arranged that light that is reflected from the target area travels along the first optical path through the first and second optical elements, the first optical element reflecting the laser radiation along a first direction and transmitting the light reflected from the target area that has traversed the first optical path in a second direction. An imaging device for viewing the plate surface may be arranged to receive the light that has been reflected from the target area and has traversed the first optical path through the first and second optical elements.

29 Claims, 3 Drawing Sheets

APPARATUS FOR COMBINED LASER FOCUSING AND SPOT IMAGING FOR MALDI

FIELD OF THE INVENTION

The present invention relates to optical and spectroscopic systems, and more particularly, but without limitation, relates to an apparatus and method for combined laser focusing and spot imaging for matrix-assisted laser desorption ionization (MALDI).

BACKGROUND INFORMATION

Matrix-assisted ionization methods such as matrix-assisted laser desorption ionization have proven useful in spectroscopic analysis of organic and biologic compounds. In the MALDI technique, a sample is combined with an organic matrix that co-crystallizes with the sample, and then deposited on a sample plate. The sample plate may contain a large number of such samples, with each sample occupying a small area on the surface of the plate. The sample plate is placed in a MALDI ion source, where a laser beam directed at the sample vaporizes the matrix, and ionizes the analyte compounds within the sample.

In a MALDI system, a laser beam is focused at a specific target area on the sample plate containing a particular sample of interest. An imaging device is setup to visualize the target area and the trajectory of the laser beam, to locate the sample of interest and ensure it is in the target area, to confirm that the laser beam is aligned correctly for impacting the sample in the target area and also to view the interaction of the laser beam with the sample matrix.

In conventional MALDI sources, the laser beam that is used to vaporize the sample and the optical radiation (usually visible light radiation) which reflects off of the sample and is captured by the imaging device, follow separate optical paths. In particular, the laser beam, which may comprise ultraviolet radiation, is usually directed along a dedicated optical path separate from other optical paths. Because of the separation between these optical paths, misalignment errors, in which the area on the sample plate surface viewed using the imaging device does not match the target area impacted by the laser beam, can be difficult to avoid, with the result that it is difficult to determine whether the laser beam is directed at the sample of interest in the target area.

Moreover, employment of optical devices that can enhance the resolution of such systems by allowing the viewing and the ionization of smaller target areas and samples, such as powerful optical lenses that provide focusing and magnification, is especially problematic in MALDI systems in which the laser and visible optical paths are separate, since the employment of such devices in either optical path (or both) can exacerbate the misalignment of the paths, or require expensive and duplicative mechanisms for readjustment of the paths. Since increased optical resolution can enhance the throughput and efficiency of MALDI sources, there is a need for a MALDI system and method in which such misalignment problems are not likely to occur, or are likely occur to a much more limited extent, enabling the employment of optical devices that facilitate improved sample utilization and throughput.

SUMMARY OF THE INVENTION

In one aspect, the present invention provides an ion source that comprises a sample plate for receiving a sample, a laser for producing laser radiation to ionize the sample, a first optical element arranged so as to direct the laser radiation along a first optical path toward the target area, and a second optical element arranged along the first optical path to focus the laser radiation onto the target area. The first and second optical elements are arranged such that light that is reflected from the target area travels along the first optical path through the first and second optical elements, the first optical element reflecting the laser radiation along a first direction and transmitting the light reflected from the target area that has traversed the first optical path in a second direction. An imaging device for viewing the plate surface may be arranged to receive the light that has been reflected from the target area and has traversed the first optical path between the first and second optical elements in the second direction.

In one embodiment, the ion source may further include a third optical element arranged in the first optical path between the first and second optical elements. The third optical element is arranged to reflect the laser radiation directed in the first direction toward the second optical element and to direct reflected light directed in the second direction toward the first optical element.

In another aspect, the present invention provides a method for matrixassisted laser desorption ionization comprising directing ultraviolet (UV) laser radiation along a first optical path to a target area to ionize a sample in the target area, and capturing optical radiation reflected from the target area that traverses the first optical path.

Also included in the invention is a mass spectrometer in which the ion source and method for matrix-assisted laser desorption ionization may be employed.

DETAILED DESCRIPTION

It is initially noted that reference to a singular item herein includes the possibility that there are plural of the same items present. More specifically, as used herein and in the appended claims, the singular forms "a", "an", "said" and "the" include plural referents unless the context clearly dictates otherwise.

Figure 1:
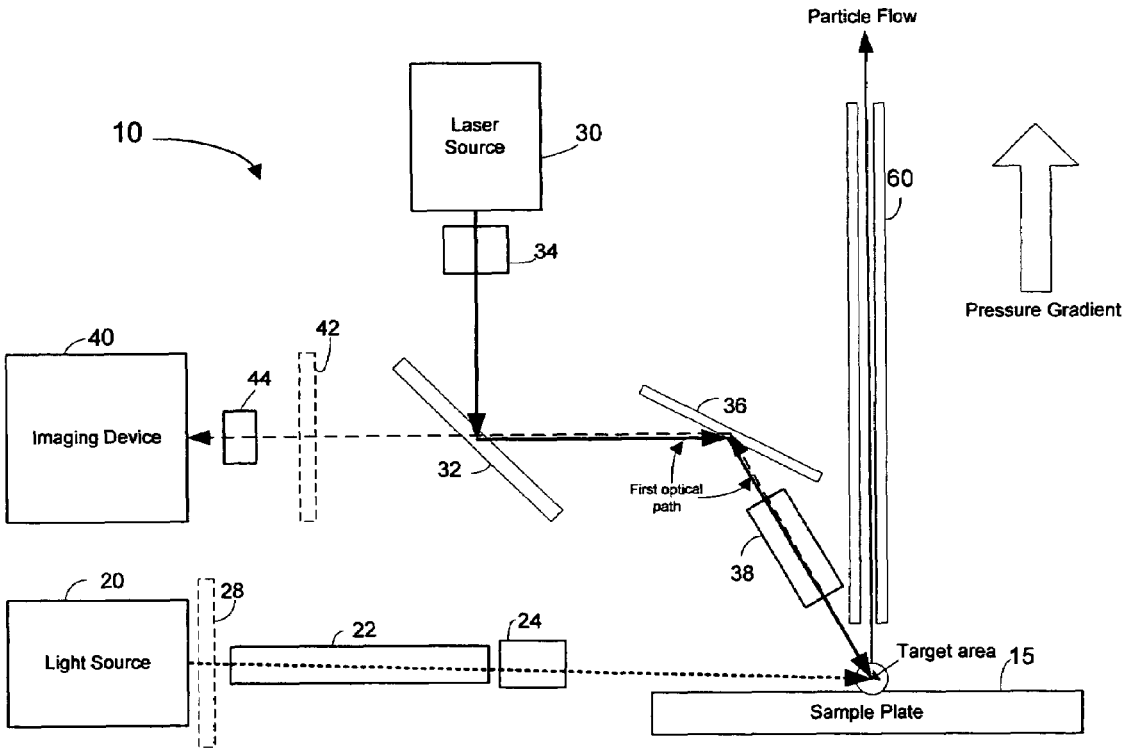
FIG. 1 is a schematic illustration of an exemplary embodiment of a MALDI ion source according to an embodiment of the present invention.

FIG. 1 shows a schematic illustration of a first embodiment of a MALDI ion source according to the present invention. The ion source 10 includes a movable sample plate 15 having a surface containing one more spatially distinct matrix-based analyte samples, an illumination device 20 that is positioned to cast a light beam which contacts an area on the sample plate surface, and a laser source 30 that generates a beam of high-intensity coherent radiation directed onto a target area on the sample plate surface. The ion source 10 also includes an imaging device 40 for imaging the area on the sample plate illuminated by the illumination device, or a portion thereof. These elements are positioned with respect to one another and further optical elements (described below) such that the laser radiation impinging the target area of the sample plate, and light reflected by (or emitted from) the sample plate and thereafter captured by the imaging device, partially share the same optical path. It is noted that all of the above-described elements are not necessarily (and generally are not) contained within an enclosed space or chamber. For example, the imaging device and the laser source can both be positioned externally to the chamber that contains the sample plate.

Referring again to FIG. 1, the illumination device 20 is positioned adjacent to and distanced from the sample plate 15. The illumination device 20 may be used to illuminate the sample plate 15 directly, or optical elements such as an optical fiber 22 and/or a lens element 24 may be positioned adjacent to the illumination device between it and the sample plate to enhance the directionality and/or focus of the light emanating from the illumination device (hereinafter termed "illumination radiation") prior to its reaching the surface of the sample plate. A filter 28 may also be optionally included directly adjacent to the illumination source 20 for filtering and/or polarizing the illumination radiation. In one embodiment, the illumination source and associated optical is omitted and the target area is illuminated with ambient light.

In an advantageous implementation, the illumination device 20 is arranged so that the illumination radiation contacts the sample plate surface at a grazing angle of between 0 and 15 degrees as described in co-pending and commonly assigned U.S. patent application Ser. No. 11/148,786 entitled "Ion Source Sample Plate Illumination System". It is emphasized however, that this configuration is merely an advantageous implementation and should not be regarded as limiting the scope of the invention in any way.

Laser source 30 may be positioned so as to direct a laser beam at an angle with respect to the direction of the illumination radiation when the illumination is from a directed source. In the depicted embodiment, the laser beam is approximately perpendicular to the illumination radiation, but this merely represents one implementation and is also not to be regarded as limiting the scope of the invention. The laser source 30 generates coherent radiation of an intensity and frequency suitable for the vaporization of the matrix of the sample and the subsequent ionization of the analyte molecules. In many spectroscopic applications, ultraviolet radiation is found to have suitable photonic energy for the purposes of matrix-assisted desorption and ionization.

The impact of the laser beam on the matrix causes vaporized ions to flow off of the sample plate in a plume which are attracted by gas flows and/or electrostatic forces present in the ion source 10 to a capillary 60. The ions and any entrained gases are drawn through the capillary towards a mass analyzer (not shown) by a pressure gradient.

A first optical element 32 is positioned between the laser source 30 and the sample plate 15 in the initial path of the beam emitted from the laser source. The first optical element 32 is semi-reflective and may comprise a beamsplitting mirror that can reflect a substantial portion of incident radiation in the ultraviolet band and can also transmit a substantial portion of incident radiation in the visible band. Suitable beamsplitters are known in the optical arts. A lens element 34 may be positioned adjacent to and in front of the laser source to condition the laser beam on its initial path towards the first optical element 32. The first optical element 32 may be oriented at an angle in a range from 30 and 60 degrees to the initial path of the laser beam; in an advantageous implementation the first optical element may be oriented at approximately 45 degree to the path of the laser beam so that the incident laser beam is reflected in a direction approximately perpendicular to its initial path. The laser beam reflected off of the first optical element 32 travels along a 'first optical path' that extends between the first optical element and a target area on the sample plate 15. The direction of the reflected laser beam along the first optical path from the first optical element 32 to the target area is hereby denoted as the 'first' direction and the opposite direction which reflected optical radiation takes along the first optical path from the target area to the first optical element 32 is denoted as the 'second' direction. It is noted that while FIG. 1 shows the paths of the laser beam traveling in the first direction and reflected light traveling in the second direction along the first optical path as slightly spatially separated, this is merely for illustrative purposes, and the laser radiation and optical radiation overlap spatially.

A second optical element 38 is positioned in the optical path further along in the first direction with respect to the first optical element 32, and may be positioned adjacent to the sample plate, depending on various optical factors and parameters as is well known to those of skill in the art. In particular, the 'working distance', which is the distance between the second optical element 38 and the target area on the sample plate, can be about 20 mm or greater. The second optical element 38 is refractive and comprises one or more lens elements that are effective with respect to the laser radiation, i.e., one or more ultraviolet lenses if the laser comprises ultraviolet radiation. The second optical element 38 may have high focusing and magnification power and may serve to focus the laser toward a small target area on (or below) the sample plate for ionizing a selected sample within the targeted area. The target area of the laser beam, through the focusing power of the second optical element can be reduced to an area as small as 25 micrometers, which can dramatically improve the sample resolution.

In the depicted embodiment, a third reflective optical element 36, positioned between the first and second optical elements 32, 38, reflects and redirects incident radiation. Preferably, the third reflective element 36 may be effective in reflecting optical radiation in both the visible and ultraviolet bands. The third optical element 36 allows for the convenient spacing of the arrangement of the sample plate 15, illumination source 20, laser source 30 and imaging device as described and depicted in FIG. 1.

Optical radiation traveling along the first optical path in the second direction from the target area is reflected off of the third optical element 36 toward the first optical element 32. A substantial portion of the optical radiation is transmitted through the first optical element 32 toward imaging device 40. A filter element 42, which may comprise, for example, an ultraviolet blocking filter and/or a polarization filter and an optical lens element 44 may be positioned in between the first optical element 32 and the imaging device 40. The filter element 42 may block ultraviolet radiation and/or enhance the polarization of the optical radiation that is transmitted from the first optical path through the first optical element 32, removing extraneous radiation that can interfere with imaging. The optical lens element 44 focuses transmitted optical radiation toward the light-detecting elements of the imaging device 40.

The imaging device 40 may comprise any detection device that is responsive to optical radiation including, for example, a camera, although a camera that provides a digitized output is most readily employed, such as a charge-coupled device (CCD) or a complementary metal-oxide semiconductor (CMOS) camera. The imaging device may be coupled to a monitor outside of the ion source (shown in FIG. 3) for viewing purposes.

In one embodiment, the optical radiation traveling along the first optical path in the second direction may comprise fluorescence radiation that is emitted from the target area in response to laser excitation, and the optical elements 42, 44 and the imaging device 40 may be also selected for optimal transmission, detection and observation of this phenomenon.

In terms of operation, the laser beam generated by the laser source 30 is focused by lens element 34 and then reflected by the first optical element 32 which redirects it at an angle along the first optical path in the first direction. Along the first optical path, the laser beam is reflected by the third optical element at an angle toward the target area on the sample plate 15. Along the path to the target area, the laser beam passes through the second optical element 38 where it is focused, which reduces its diameter and eventually increases the intensity of the beam before its impact at the target area.

The impact of the laser beam desorbs and vaporizes a substantial portion of the matrix and analyte contained in the target area. Some of the molecules of the matrix are also ionized by the laser beam; the matrix ions then ionize analyte molecules by a process of charge transfer. The vaporized particles are released as a plume and then the ions within the plume are guided electrostatically and/or by gas flow towards the entrance of a capillary 60 that transports the ions towards downstream stages of a mass spectrometer, including a mass analyzer. In addition, if the matrix includes fluorescing compounds, the laser beam may excite such compounds and they may emit fluorescence radiation in response to the laser excitation.

Simultaneously, the illumination radiation from the illumination source is directed onto the sample plate 15 with the intention of illuminating the area on the sample plate surface including the target area. The most important application of the illumination is to locate the sample crystals in the target area; however, the illumination also allows the impact of the laser beam on the sample to be captured and recorded or viewed in real time via a monitor. As discussed above, the illumination radiation may be filtered, guided and focused by optical elements 22, 24, 28 to increase the focus and intensity of illumination at a small area of the surface of the sample plate 15.

Illumination radiation is reflected, diffracted and/or scattered from the surface of the sample plate 15 at or near the target area, and a portion of this reflected optical radiation travels along the first optical path in the second direction. Along the first optical path, the optical radiation is focused by the second optical element 38, then reflected by the third optical element 36 toward the first optical element. A substantial portion of the optical radiation is transmitted through the first optical element 32 towards the imaging device 40. The optical radiation may be filtered and focused again by respective optical elements 42, 44 before reaching the imaging device 40.

According to this method, as long as the illumination radiation encompasses the area in which the laser beam impacts the sample plate, a view of the target area is captured by the imaging device because both the optical radiation captured by the imaging device and the laser beam travel along the same optical path and are modified by the same refractive optical element, i.e., the second optical element 38 within that path. Conversely, as long as the imaging device 'views' the sample of interest in the target area, the laser beam will be directed onto the sample. For example, if the angle of the third optical element 36 is altered accidentally, this alteration will alter the trajectory of the laser beam as it reflects off of this element so that the target area of the laser beam will change. Equally, however, any optical radiation reflected by the 'new' target area will have the same angular trajectory as the laser beam as it travels from the surface of the sample plate toward the third optical element 36, and then will be reflected by the altered third optical element back toward the first optical element 32 toward the imaging device 40. Thus, the MALDI source system of the present invention is self-correcting in that the laser beam and the optical radiation travel along the same first optical path, share common optics within that path, and automatically correspond to one another.

Figure 2:
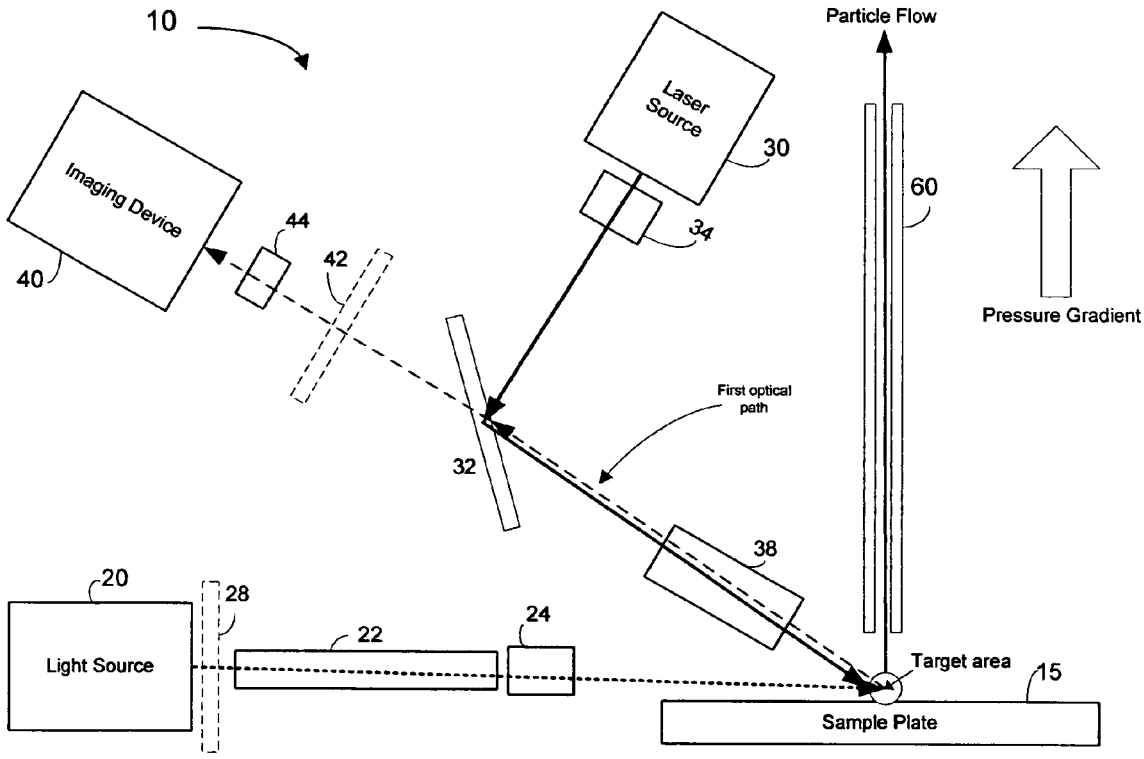
FIG. 2 is a schematic illustration of another exemplary embodiment of a MALDI ion source according to the present invention.

FIG. 2 illustrates an alternative embodiment of the present invention in which the third optical element is not employed. In this case the first optical element 32 is oriented at about 45 degrees with respect to the laser beam so that the laser beam is reflected directly toward the surface of the sample plate 15. Thus, the first optical path in this case is the path from the first optical element through the second optical element to the sample plate surface and there are no intervening reflective elements between the first and second optical elements. Likewise, reflected, scattered, diffracted or emitted optical radiation arising from the target area of the sample plate 15 travels through the second optical element 38 directly to the first optical element 32 in the opposite direction. In this embodiment, the placement of the imaging device 40 differs from the first embodiment, and it is rotated with respect to its position in the first embodiment in a clockwise direction in a range between 20 and 70 degrees (depending on the angle of the first optical element 32) to capture the optical radiation transmitted through the first optical element.

The system and method of the present invention provide numerous conveniences and advantages for performing MALDI. As noted above, misalignment errors are much more easily avoided since the ion source contains one main optical path connecting the first optical element with the target area. This eliminates visualization parallax error. This is important for directing a laser accurately onto the target area.

In addition, use of one or more high magnification ultraviolet lenses in the second optical element allows a much higher optical resolution to be obtained as well as a convenient working distance of 20 mm or greater. The laser beam can be focused using such lens elements to the degree that sub-portions of a sample may be selected, or even portions located at some depth under the surface of the sample target area. This may occur, for example, when it is desired to 'bombard' crystalline structures embedded within a liquid matrix. The high magnification lenses also allow very precise measurements of the depth and thickness of a sample as well as precise size measurements comparable with the precision of motion of the sample plate obtainable using state-of-the-art x/y stage motion control. Due to these technical advantages, the number of target areas per sample plate can be increased by more than a factor of ten. For example, sample plates having 96 sample areas are typically used in MALDI ion sources; the improved laser and image focusing of the present invention enables as many as 1536 sample areas to be deposited on a sample plate and accurately targeted for ionization and imaging.

Figure 3:
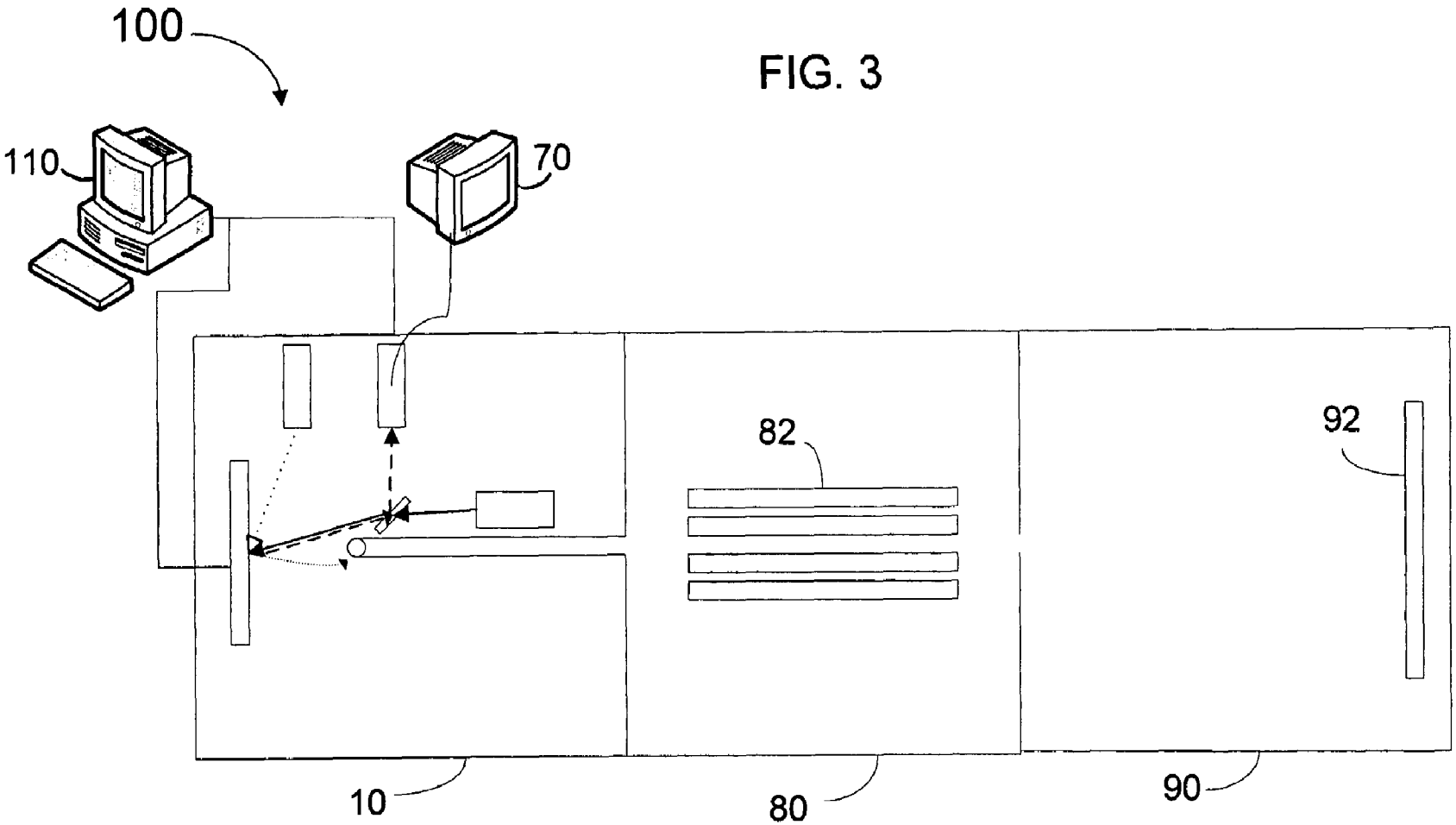
FIG. 3 is a schematic illustration of an exemplary mass spectrometer system according to the present invention.

FIG. 3 schematically illustrates a mass spectrometer system that employs a MALDI ion source described above with respect to FIG. 1. The mass spectrometer 100 includes an ion source 10 and a mass analyzer 90 containing an ion detector 92, connected by one or more intermediate chambers 80 (represented in the figure by a single chamber) which may include one or more vacuum stages and ion guides 82. An external monitor 70 may be coupled to the imaging element within the ion source for observational purposes. However, it is again noted that several of the elements depicted within the ion source enclosure in FIG. 3 can also be positioned externally, such as the imaging device, the illumination device and the laser source.

A control system 110 may be coupled to the ion source 10, and in particular may be coupled so as to receive input from the imaging device and to transmit output control signals to the sample plate 15 within the ion source. The control system may have stored algorithms for image recognition and automated target acquisition, so that it can recognize from the image information captured by the imaging device whether the target area on the sample plate includes the sample of interest and can then (depending on the received input) transmit signals to adjust the positioning of the sample plate in its plane in x and y directions using stage motion control so that the sample crystals of interest in the target area may be located.

The mass analyzer 90 of the mass spectrometer 100 may comprise a quadrupole, triple quadrupole, linear ion trap, three-dimensional ion trap, time-of-flight, orbitrap, FT-ICR (Fourier transform ion cyclotron resonance) or other mass-to-charge analyzer known in the art.

In use, if the MALDI ion source is used at atmospheric pressure, the initial intermediate chamber 80 may be maintained at a pressure of around two orders of magnitude below atmospheric and further intermediate chambers are maintained at successively lower pressures. Mass analyzer 90 is generally maintained at a pressure of about two to four order of magnitude below the intermediate chamber(s). The ions generated in the ion source 10 enter the capillary and are swept into the intermediate chamber 80, conditioned therein using ion guide(s) 82, and then transported to the mass analyzer 90 where they are detected. The mass analyzer 90 determines the m/z ratio of the ions, which may then be used to derive further information about the samples from which the ions have been generated.

Having described the present invention with regard to specific embodiments, it is to be understood that the description is not meant to be limiting since further modifications and variations may be apparent or may suggest themselves to those skilled in the art. It is intended that the present invention cover all such modifications and variations as fall within the scope of the appended claims.

What is claimed is:

1. An ion source comprising:

a sample plate for receiving a sample;

a laser for producing laser radiation to ionize the sample;

a first optical element arranged so as to direct the laser radiation along a first optical path toward a target area on the sample plate; and a second optical element arranged along the first optical path to focus the laser radiation onto the target area;

wherein the first and second optical elements are arranged such that light that is reflected from the target area travels along the first optical path through the first and second optical elements, the first optical element reflecting the laser radiation along a first direction and transmitting the light reflected from the target area that has traversed the first optical path in a second direction.

2. The ion source of claim 1, further comprising:

an imaging device for viewing the plate surface, the imaging device being arranged to receive the light that has been reflected from the target area and has traversed the first optical path between the first and second optical elements in the second direction.

3. The ion source of claim 1, wherein the first direction and the second direction are perpendicular.

4. The ion source of claim 2, further comprising:

a third optical element arranged in the first optical path between the first and second optical elements, the third optical element being arranged to direct the laser radiation between the first and second optical elements and to direct the reflected light coming from the second optical element to the first optical element.

5. The ion source of claim 4, wherein the laser comprises ultraviolet (UV) radiation and the third optical element comprises an ultraviolet (UV) mirror.

6. The ion source of claim 4, wherein the first optical element comprises a beamsplitter mirror.

7. The ion source of claim 4, wherein the laser radiation comprises ultraviolet radiation and the second optical element comprises an ultraviolet (UV) lens.

8. The ion source of claim 4, further comprising:

an optical filter element arranged between the first optical element and the imaging device.

9. The ion source of claim 8, wherein the optical filter element comprises a polarization filter.

10. The ion source of claim 8, wherein the optical filter element comprises an ultraviolet (UV) blocking filter.

11. The ion source of claim 4, further comprising:

a lens element arranged adjacent to the laser for focusing laser radiation.

12. The ion source of claim 4, further comprising:

a lens element arranged adjacent to the imaging device.

13. The ion source of claim 1, further comprising:

an illumination device for producing a light beam contacting a surface of the sample plate at a target area.

14. The ion source of claim 13, wherein the illumination device comprises a fiber optic light guide connected to a light source.

15. The ion source of claim 14, further comprising:

a lens element arranged between the optical fiber and the sample plate for focusing the light beam toward the target area.

16. The ion source of claim 13, wherein the illumination device is arranged with respect to the sample plate such that it defines a grazing angle between the light beam and the illuminated surface of the sample plate, the grazing angle being between 0 and 15 degrees.

17. A mass spectrometer system, comprising:

a) an ion source including:

a sample plate for receiving a sample;

a laser for producing laser radiation for ionizing a sample;

a first optical element arranged so as to direct the laser radiation along a first optical path towards the target area; and a second optical element arranged along the first optical path to focus the laser radiation onto the target area;

wherein the first and second optical elements are arranged such that light that is reflected from the target area travels along the first optical path through the first and second optical elements, the first optical element reflecting the laser radiation along a first direction and transmitting the light reflected from the target area that has traversed the first optical path in a second direction;

b) a mass spectrometer coupled to the ion source.

18. The mass spectrometer of claim 17, wherein the ion source further comprises an imaging device for viewing the plate surface, the imaging device being arranged to receive the light that has been reflected from the target area and has traversed the first optical path between the first and second optical elements in the second direction.

19. The mass spectrometer of claim 18, wherein the ion source further comprises a third optical element arranged in the first optical path between the first and second optical elements, being arranged to direct the laser radiation between the first and second optical elements and to direct the reflected light coming from the second optical element to the first optical element.

20. The mass spectrometer of claim 17, wherein the first optical element comprises a beamsplitter mirror.

21. The mass spectrometer of claim 17, wherein the laser radiation comprises ultraviolet radiation and the second optical element comprises an ultraviolet (UV) lens.

22. The mass spectrometer of claim 17, wherein the ion source is operated at atmospheric pressure.

23. A method for matrix-assisted laser desorption ionization comprising:

directing ultraviolet (UV) radiation along a first optical path to the target area on a sample plate, the ultraviolet radiation comprising laser radiation for ionizing a sample in the target area; and capturing optical radiation reflected from the target area that traverses the first optical path.

24. The method of claim 23, further comprising:

illuminating a target area on a surface of a sample plate.

25. The method of claim 23, further comprising:

splitting the reflected optical radiation from the ultraviolet radiation at a first end of the first optical path;

wherein the reflected optical radiation and the ultraviolet radiation travel along the first optical path in opposite directions.

26. The method of claim 23, further comprising:

focusing the ultraviolet radiation traversing the first optical path onto the target area of the sample plate.

27. The method of claim 26, further comprising:

performing the focusing using an ultraviolet (UV) lens arranged in the first optical path.

28. The method of claim 26, further comprising:

focusing the ultraviolet radiation at a target area below the surface of the sample plate.

29. The method of claim 23, further comprising:

producing an image of the target area using the captured optical radiation.

* * * * *